US005956879A

United States Patent [19]

Zerega

[11] Patent Number: 5,956,879

[45] Date of Patent: Sep. 28, 1999

[54] APPARATUS FOR AIMING A HANDGUN

[76] Inventor: James E. Zerega, 16905 Olde Mill Run, Rockville, Md. 20855

[21] Appl. No.: 08/961,087

[22] Filed: Oct. 30, 1997

[51] Int. Cl.[6] ..... F41C 23/16; F41C 27/04

[52] U.S. Cl. ..... 42/72

[58] Field of Search ..... 42/72, 75.01

[56] References Cited

U.S. PATENT DOCUMENTS

| | | | |
|---|---|---|---|
| 1,363,809 | 12/1920 | Payne | 42/72 |
| 2,056,975 | 10/1936 | Michal, Jr. . | |
| 2,139,691 | 12/1938 | Michal, Jr. | 42/72 |
| 2,435,217 | 2/1948 | Howell, Jr. . | |
| 2,972,933 | 2/1961 | Gutherie et al. | 42/75.01 |
| 3,798,818 | 3/1974 | Casull | 42/72 |
| 4,271,623 | 6/1981 | Beretta . | |
| 4,893,426 | 1/1990 | Bixler | 42/75.01 |
| 5,048,215 | 9/1991 | Davis | 42/72 |
| 5,068,992 | 12/1991 | Velezis et al. | 42/72 |
| 5,351,598 | 10/1994 | Schuetz | 89/185 |
| 5,417,002 | 5/1995 | Guerra . | |

*Primary Examiner*—Charles T. Jordan
*Assistant Examiner*—Denise J. Buckley
*Attorney, Agent, or Firm*—Robert E. Bushnell, Esq.

[57] ABSTRACT

A guard including a handle and having a tang received in a mounting device mounted on a handgun, providing a user with dual-handled control over the handgun.

25 Claims, 5 Drawing Sheets

APPARATUS FOR AIMING A HANDGUN

REFERENCE TO RELATED DISCLOSURE

This application makes reference to and incorporates Disclosure Document No. 414148, entitled PISTOL FRONT HANDLE AIMING IMPROVEMENT DEVICE, filed in the U.S. Pat. & Trademark Office on Feb. 21, 1997.

BACKGROUND OF THE INVENTION

1. Field of the Invention

The present invention relates to ordnance, and, more specifically, the present invention relates to handles of small bore, short barrel ordnance.

2. Discussion of the Related Art

Currently, one or two hands are used to aim a handgun. Unfortunately, even when two hands are used, maintaining the requisite horizontal and vertical control over the firearm is difficult. The primary reason for this difficulty is inherent in the design of a conventional handgun. Specifically, handguns are configured to be relatively small, as compared with rifles, and have a single, hand-sized handle by which a user grips the handgun. This singular point of contact does not lend to easy control and aiming of the handgun.

Exemplars of contemporary practice in the prior art fall into two groupings. The first grouping includes those devices that are permanently attached to a firearm. For example, U.S. Pat. No. 4,271,623 to Beretta, entitled Pistol With Stock Extension And Auxiliary Grip, describes an auxiliary grip that pivots to the barrel of a handgun. U.S. Pat. No. 5,417,002 to Guerra, entitled Adjustable Firearm Handle, describes a handle extending from a bracket that slides radially about the barrel of a rifle. The bracket includes a spring-loaded lock to fix placement thereof relative to the barrel. The second grouping pertains to removable firearm devices. For example, U.S. Pat. No. 2,435,217 to Howell Jr., entitled Firearm And Stock Structure Therefor, which describes a rifle including a bayonet-type recess for a handle. Once inserted, the handle is secured to the barrel with a threaded fastener. U.S. Pat. No. 2,056,975 to Michal Jr., entitled Machine Gun And Converter Therefor, describes an auxiliary handle extending from a bracket screw-mounted on and extending beyond the barrel of a handgun. The device does not include protective structure other than necessary to support the handle.

After comprehensive analysis of the exemplars of contemporary practice in the prior art, I have found a need exists for a device that improves the ability of a user to exert horizontal and vertical control over a handgun to improve the aiming thereof.

SUMMARY OF THE INVENTION

The present invention overcomes the limitations of the prior art by providing a device which affords a user greater control over a handgun. The invention includes a guard, a handle mounted to the guard and a mounting device, mounted on the handgun, which receives and locks the guard to the handgun.

In view of the above, a first object of the invention is to provide an improved handle for a handgun.

A second object of the invention is to provide a detachable second handle for a handgun.

A third object of the invention is to provide a handle for, that is adjustable relative to, a handgun.

A fourth object of the invention is to provide an aiming device which is readily installable on a handgun.

A fifth object of the invention is to provide improved elements and arrangements thereof, in an apparatus for the purposes described, which is inexpensive, dependable and effective in accomplishing its intended purposes.

These and other objects of the present invention will become readily apparent upon further review of the following specification and drawings.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
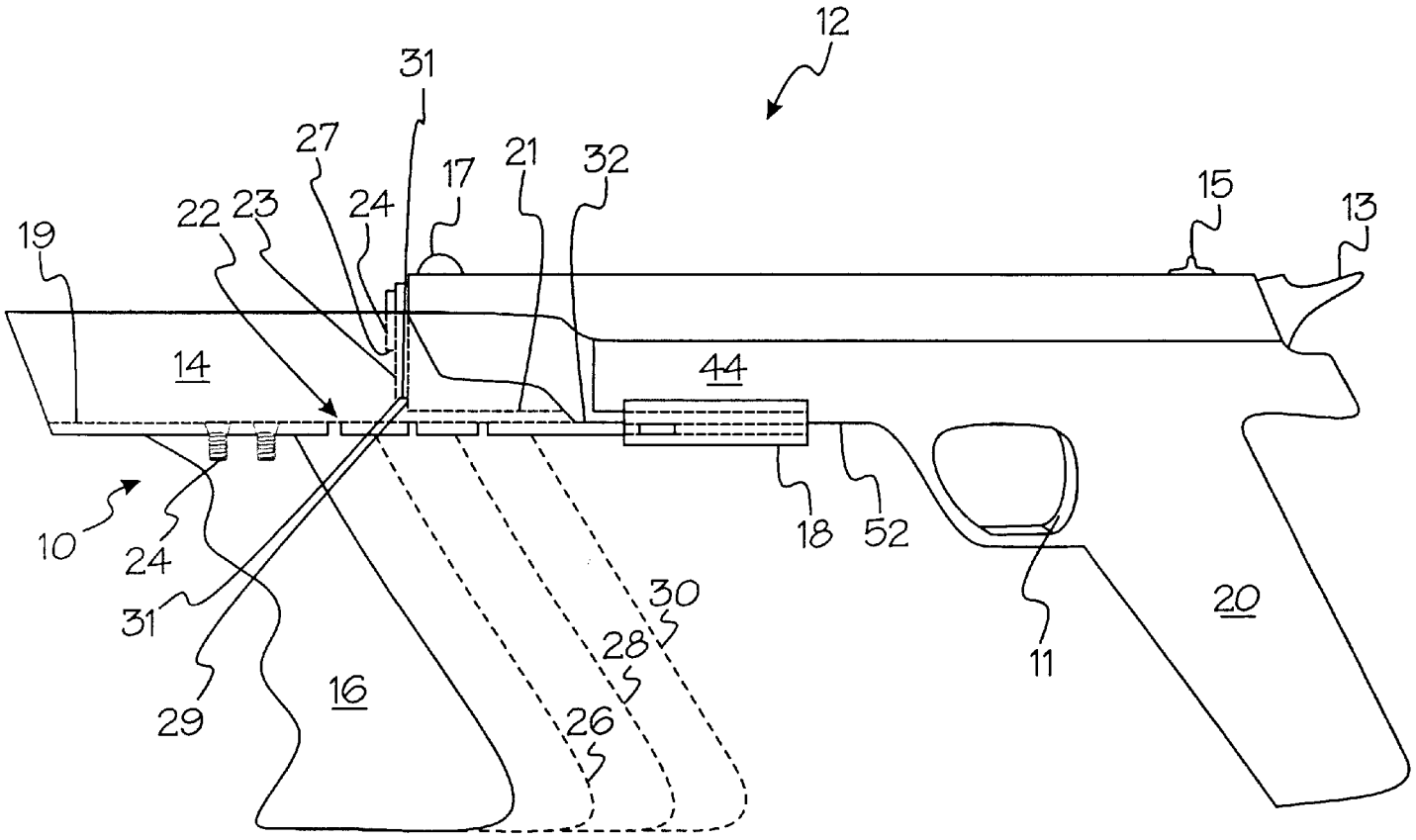
FIG. 1 is a left side elevational view of the present invention mounted on a handgun, alternate positions of the handle thereof being shown in phantom lines.

Referring to FIG. 1, an embodiment of the principles of the present invention constructed as shown mounted on a handgun 12. The handgun 12 has a trigger 11, a hammer 13, a near sight 15 and a far sight 17. The device 10 includes three basic components: a guard 14; a handle 16; and a mounting device 18.

Figure 2:
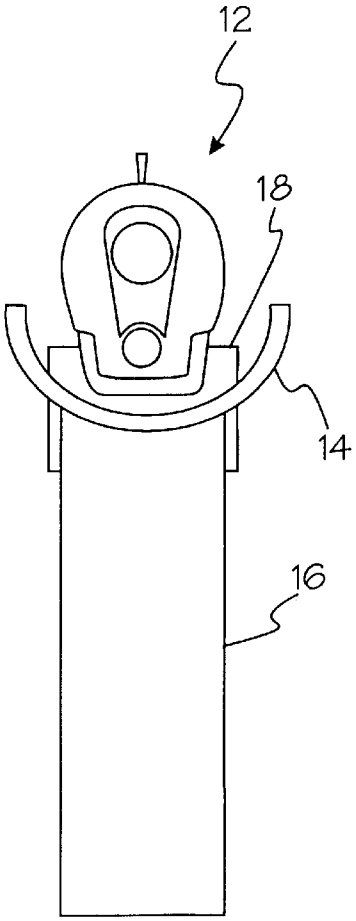
FIG. 2 is a front elevational view of the invention mounted on a handgun.

Referring also to FIG. 2, the guard 14 serves two functions. First, the guard 14 must possess sufficient structural integrity to provide a user with a stable aiming platform for the handgun. Second, the guard should be configured so as to prevent inadvertent entry of the user's fingers, or other objects, from entry into the line of fire. Toward these ends, the guard 14, preferably, possesses a semi-cylindrical shape. The use of a semi-circular shape is helpful to the execution of the invention. The preferred semi-circular shape lends greater structural rigidity to the guard (than a straight bar, for example) even where thin gauge or inherently pliable materials are employed. For example, although cardboard may not be an ideal material from which to construct the guard 14, when the material is urged to assume a semi-cylindrical shape, it becomes substantially more rigid than when it assumes its natural planar state.

Second, the semi-cylindrical shape also serves to deter inadvertent intrusion of the user's fingers from blast and the accompanying hot gases attendant upon the discharge of a projectile from the barrel. Precisely what boundaries the guard 14 defines is a matter of safety and design choice.

Referring again to FIG. 1,the inner surface 19 of the guard 14 does not contact the barrel 44 of the handgun 12, as indicated by the edges 21, 23, 24, 27, 29 and 31.

The handle 16 is mounted onto the guard 14. The handle 16 provides a second point of control over the handgun 12.

The handle 16 need not assume any particular configuration, so long as it possesses sufficient size and provides sufficient comfort to the user to achieve the purposes of the present invention. By grasping both handle 16 and grip 20, the user gains substantially more control over the vertical and horizontal aiming of the handgun 12 than in a case where the user may grasp only the grip 20.

The handle 16 may be mounted on the guard 14 by a number of different techniques. Preferably, threaded fasteners 24 are used to connect the handle 16 and guard 14. As shown, the guard 14 has a plurality of apertures 22 therein for receiving any number of fasteners 24. This construction permits the handle to be adjusted relative to the guard 14, such that it may assume different spatial relationships 26, 28 or 30, relative to the grip 20.

Figure 3:
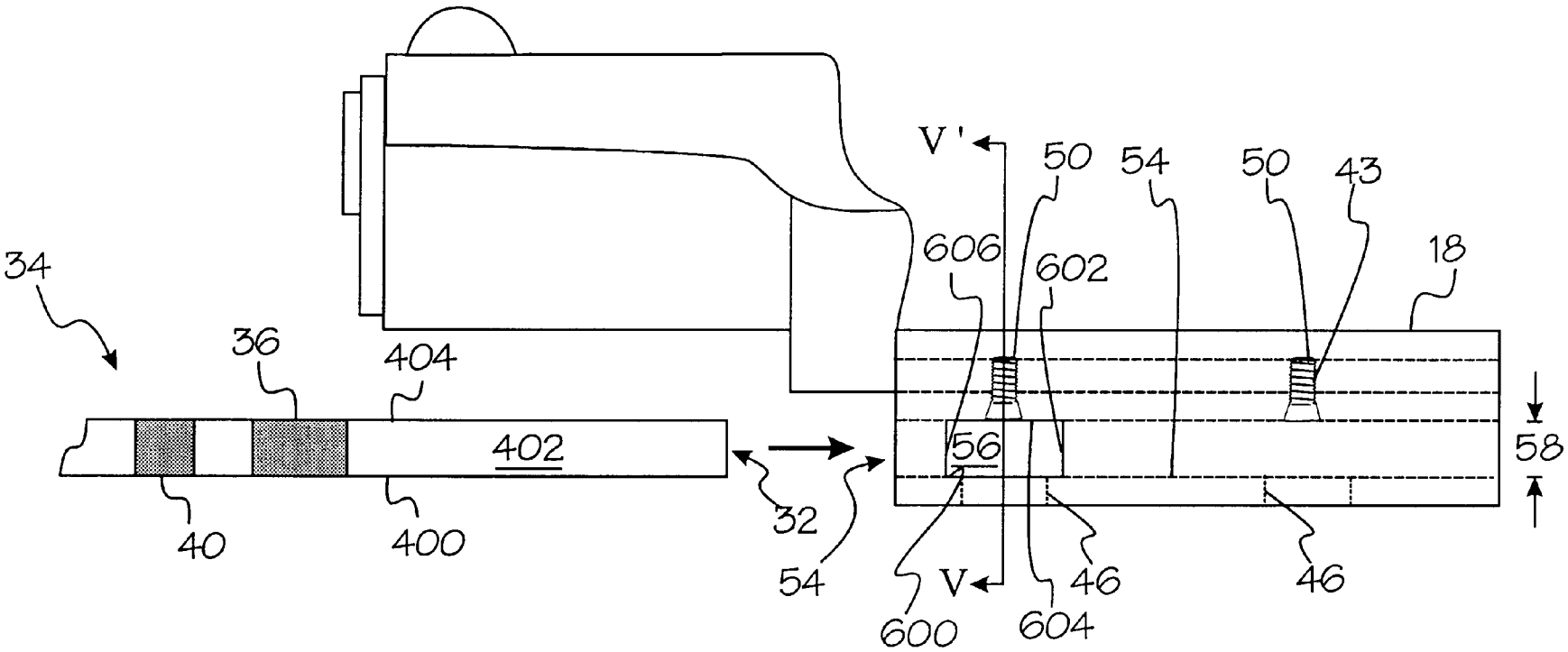
FIG. 3 is an enlarged, partial left side elevational view, partially in cross-section, receiving the tang of the guard.
Figure 4:
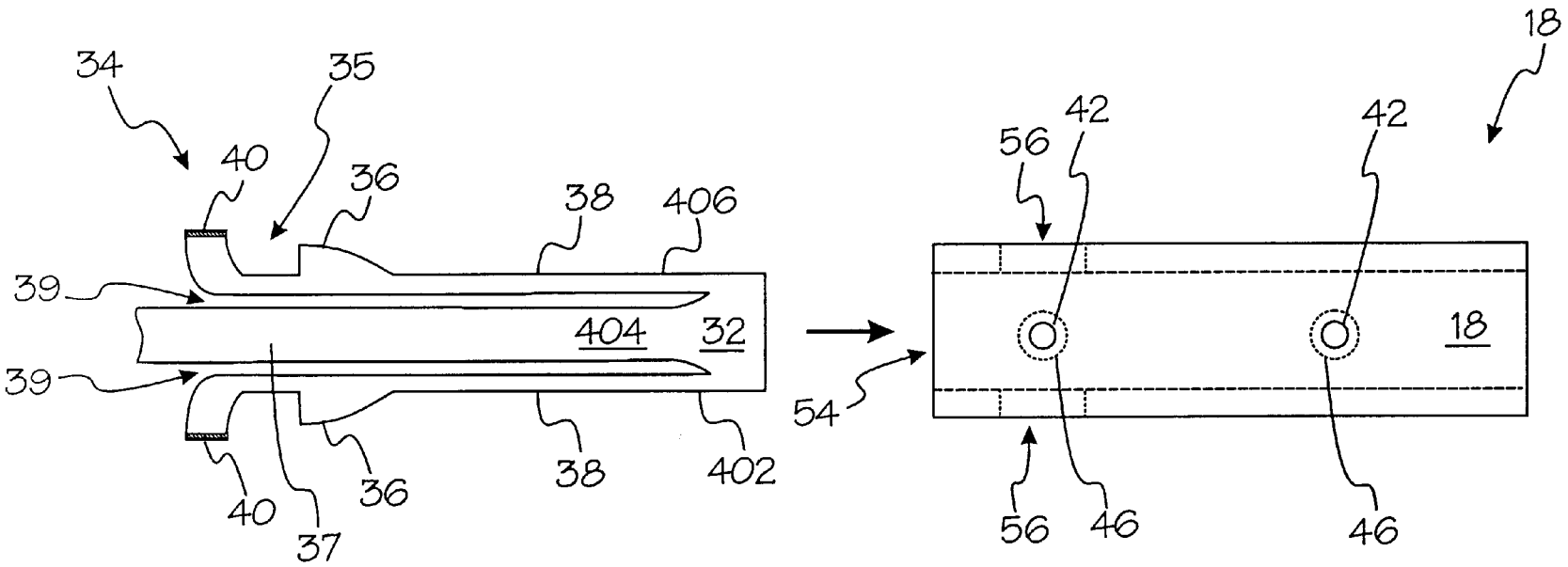
FIG. 4 is a partial plan view of the mounting device, detached from a handgun, receiving the tang of the guard.

Referring also to FIGS. 3 and 4, the guard 14 has a tang 32, as shown in FIG. 1. The tang 32 accommodates a lock 34 that secures the guard 14 to the mounting device 18. Preferably, one embodiment of the lock 34 employs a clip 36 formed on the end of an extension 38 of the tang 32. The extension 38 and a non-extension portion 37 of the tang 32 define a gap 39. The extension 38 biases the clip 36 relative to the tang 32. Embodiments of this invention also may include a release button 40 mounted on the extension 38 or otherwise fixed to the clip 36. Preferably, a space 35 separates the clip 36 and release button 40.

Figure 5:
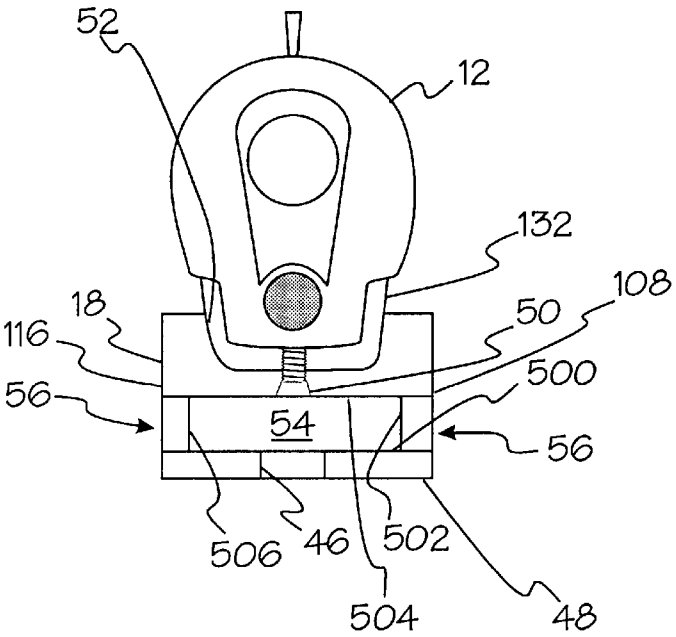
FIG. 5 is a cross-sectional detail view of the mounting device mounted on a handgun, drawn along sectional line V—V' in FIG. 3.
Figure 6:
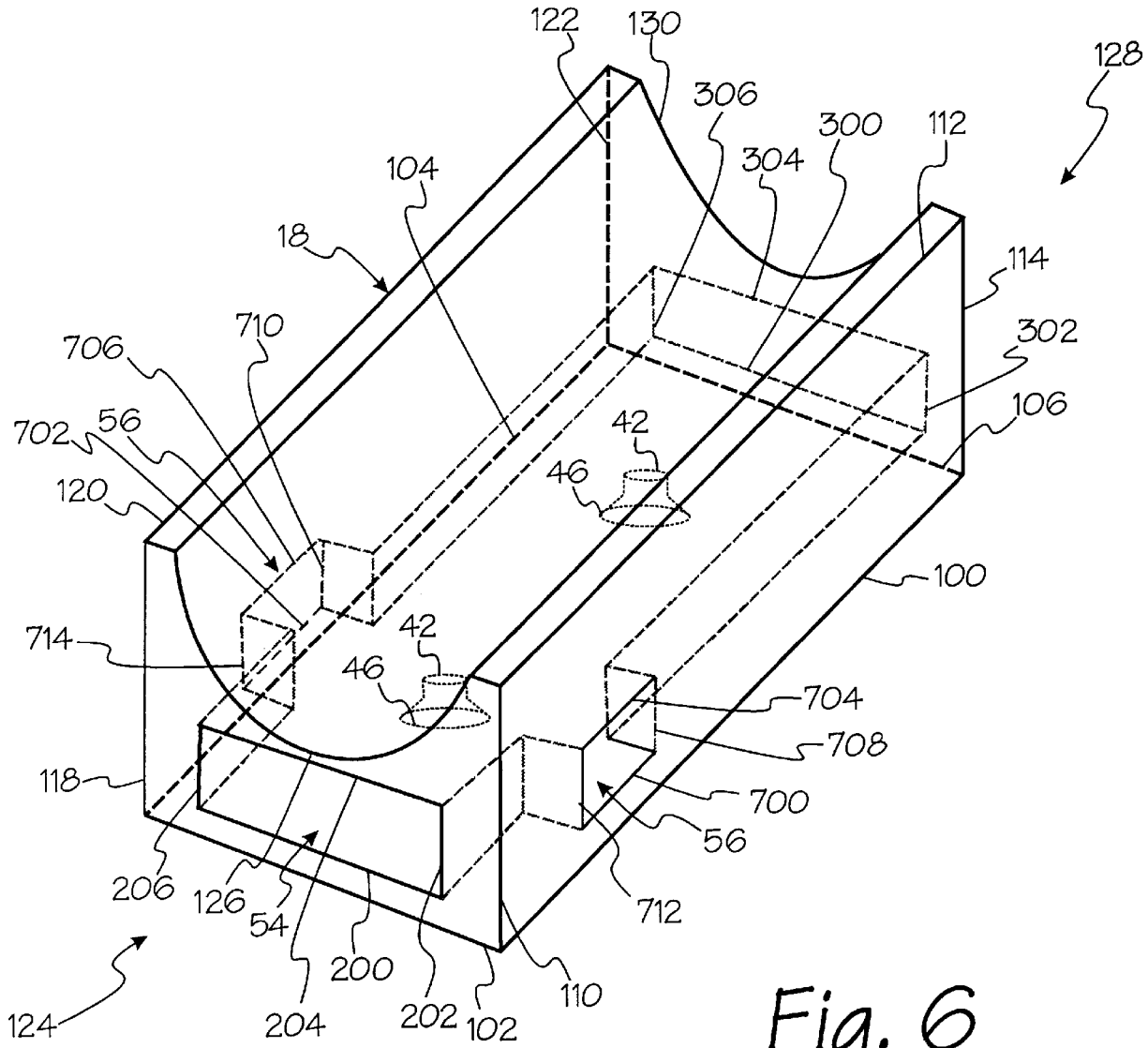
FIG. 6 is a top right front perspective view of the mounting device of the present invention.

Referring also to FIGS. 5 and 6, the mounting device 18 has a bottom 48, as shown in FIG. 5, defined by the edges 100, 102, 104 and 106, as shown in FIG. 6. The mounting device 18 has a right side 108, as shown in FIG. 5, defined by the edges 100, 110, 112 and 114, as shown in FIG. 6. The 18 has a left side 116, as shown in FIG. 5, defined by edges 104, 118, 120 and 122, as shown in FIG. 6. The mounting device has a front side 124 defined by edges 102, 110, 118, and curve 126, as shown in FIG. 6. The mounting device has a back 128 defined by edges 106, 114, 122 and curve 130, as shown in FIG. 6. A contour 52, shown in FIG. 5, is defined by the surface between curves 126 and 130, as shown in FIG. 6.

The mounting device 18 includes apertures 42 to accommodate threaded fasteners 50 that engage threaded holes 43 in the frame 132 of the handgun 12. Alternative fasteners may be used to attach the mounting device to the handgun. In this particular embodiment, access holes 46 are provided in the bottom side 48 of the mounting device 18. The access holes 46 allow for insertion of the threaded fastener 50, or like fastener elements, as well as any tool necessary to install these threaded fasteners.

The contour 52 of the mounting device 18 complements the contour, as shown in FIG. 5, of the frame 132 of the handgun 12. The mounting device 18 may assume any configuration commensurate with the handgun selected by one practicing the present invention. This contour configuration should not be interpreted as excluding other mechanisms for stabilizing the relationship between the mounting device 18 and the handgun 12. This embodiment of the invention assures that the device is stable with respect to the handgun so as to aid in the aiming of the handgun and not introduce unwanted play.

The mounting device 18 has a slot 54 configured to receive the tang 32 extending from the guard 14. The slot 54 has a first surface 500, as shown in FIG. 5, defined between edges 200 and 300, as shown in FIG. 6. The slot 54 has a second surface 502, as shown in FIG. 5, defined between edges 202 and 302, as shown in FIG. 6. The slot 54 has a third surface 504, as shown in FIG. 5, defined between edges 204 and 304, as shown in FIG. 6. The slot 54 has a fourth surface 506, as shown in FIG. 5, defined between edges 206 and 306, as shown in FIG. 6.

Referring also to FIGS. 3 and 4, the tang 32 and non-extension portion 37 present surfaces 400, 402, 404 and 406. The tang 32 should be closely received in the slot 54 so as to provide a minimum of play between tang 32 and slot 54. When received, the surfaces 400 and 500, 402 and 502, 404 and 504, and 406 and 506 are in close contact.

The mounting device 18 also has apertures 56 which are configured to receive the clips 36 of the tang 32. Each aperture 56 is defined by two continuous surfaces 600 and 604, and two discontinuous surfaces 602 and 606, as shown in FIG. 3. The discontinuity of the discontinuous surfaces 602 and 604 is occasioned by intersection with the slot 54, as described above. Continuous surface 600, as shown in FIG. 3, is defined by edges 700 and 702, as shown in FIG. 6. Continuous surface 604, as shown in FIG. 3, is defined by edges 704 and 706, as shown in FIG. 6. Discontinuous surface 602, as shown in FIG. 3, is defined by edges 708 and 710, as shown in FIG. 6. Discontinuous surface 606, as shown in FIG. 3, is defined by edges 712 and 714, as shown in FIG. 6.

Although the aperture 56 is shown having a height 58, as shown in FIG. 3, coextensive with that of the slot 54, in other embodiments, these heights may be different. Also, the aperture-and-clip convention shown and described illustrates only one possible mechanism for locking the guard 14 to the mounting device 18 and should not be construed as excluding other mechanisms.

In an operation, the user inserts the tang 32 into the slot 54 by a sufficient distance so that the clip 36 snaps into place within the aperture 56. To disassemble the device from the handgun, the user squeezes together the release buttons 40, with the user's thumb and forefinger, for example, so that the clips 36 are completely dislodged from the apertures 56, thus allowing the tang 32 to be removed from the slot 54.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An apparatus for aiming a handgun, comprising: a guard, further comprising a tang extending therefrom, said tang further comprising a clip extending therefrom in a first direction;

a handle adjustably mounted on said guard; and a mounting device, further comprising a contour complementary of a shape of a barrel of the handgun, a slot receiving said tang and an aperture receiving said clip, said mounting device being connected to the handgun with a threaded fastener.

2. The apparatus of claim 1, further comprised of said clip being biased into said aperture.

3. The apparatus of claim 1, said tang further comprising a second clip extending in a second direction said mounting device further comprising a second aperture receiving said second clip.

4. The apparatus of claim 3, further comprised of said second direction being opposite to said first direction.

5. The apparatus of claim 3, whereby urging said clip and said second clip toward each other releases said tang from said mounting device.

6. The apparatus of claim 3, further comprised of said clip and said second clip being biased away from each other.

7. The apparatus of claim 1, said tang further comprising a release button selectably urging said clip from said aperture.

8. The apparatus of claim 1, said tang comprising a release button fixed relative to said clip.

9. The apparatus of claim 1, further comprised of said guard being circumferentially-spaced from and about a barrel of the handgun.

10. The apparatus of claim 1, further comprised of said handle being mounted on said guard with a threaded fastener.

11. An apparatus for aiming a handgun, comprising:

a guard demountably connected to the handgun; and a handle adjustably mounted on said guard.

12. An apparatus for aiming a handgun, comprising:

a guard;

a handle mounted on said guard;

a tang extending from said guard; and a mounting device, demountably connected to the handgun, receiving said tang.

13. The apparatus of claim 12, further comprised of said mounting device having a contour complementary of a shape of a barrel of the handgun.

14. The apparatus of claim 12, further comprised of said mounting device being connected to the handgun with a threaded fastener.

15. An apparatus for aiming a handgun comprising:

a guard:

a handle mounted on said guard;

a tang extending from said guard;

a clip extending from said tang in a first direction; and a mounting device, demountably connected to the handgun;

said mounting device further comprising a slot receiving said tang and an aperture receiving said clip.

16. The apparatus of claim 15, further comprised of said clip being biased into said aperture.

17. The apparatus of claim 15, said tang further comprising a second clip extending in a second direction said mounting device further comprising a second aperture receiving said second clip.

18. The apparatus of claim 17, further comprised of said second direction being opposite to said first direction.

19. The apparatus of claim 17, whereby urging said clip and said second clip toward each other releases said tang from said mounting device.

20. The apparatus of claim 17, further comprised of said clip and said second clip being biased away from each other.

21. The apparatus of claim 15, said tang further comprising a release button selectably urging said clip from said aperture.

22. The apparatus of claim 15, said tang comprising a release button fixed relative to said clip.

23. The apparatus of claim 11, further comprised of said guard being circumferentially-spaced from and about a barrel of the handgun.

24. The apparatus of claim 11, further comprised of said handle being adjustably mounted on said guard.

25. The apparatus of claim 11, further comprised of said handle being mounted on said guard with a threaded fastener.

* * * * *